US009376994B2

(12) United States Patent
Grandi et al.

(10) Patent No.: US 9,376,994 B2
(45) Date of Patent: Jun. 28, 2016

(54) VALVE ASSEMBLY FOR AN INJECTION VALVE AND INJECTION VALVE

(75) Inventors: Mauro Grandi, Leghorn (IT); Valerio Polidori, Leghorn (IT); Cristiano Mannucci, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 429 days.

(21) Appl. No.: 13/876,848

(22) PCT Filed: Sep. 29, 2011

(86) PCT No.: PCT/EP2011/067033

§ 371 (c)(1),
(2), (4) Date: Mar. 28, 2013

(87) PCT Pub. No.: WO2012/041984

PCT Pub. Date: Apr. 5, 2012

(65) Prior Publication Data

US 2013/0181070 A1 Jul. 18, 2013

(30) Foreign Application Priority Data

Sep. 30, 2010 (EP) ..... 10183713

(51) Int. Cl.
*F02M 51/06* (2006.01)
*H01F 7/16* (2006.01)

(52) U.S. Cl.
CPC ..... *F02M 51/061* (2013.01); *F02M 51/066* (2013.01); *F02M 51/0689* (2013.01); *H01F 7/1615* (2013.01)

(58) Field of Classification Search
CPC ..... F02M 51/061; F02M 51/066; F02M 51/0689; F02M 51/0685; F02M 51/0625; F02M 51/0635; F02M 51/0642; F02M 51/0653; F02M 51/0657; H01F 7/1615
USPC ..... 239/585.1
See application file for complete search history.

(56) References Cited

U.S. PATENT DOCUMENTS 5,190,223 A 3/1993 Mesenich ..... 239/585.5
5,730,369 A 3/1998 De Nagel et al. ..... 239/585.4

(Continued)

FOREIGN PATENT DOCUMENTS

CN 101539084 A 9/2009 ..... F02M 51/06
DE 3704542 A1 8/1988 ..... F02M 51/06

(Continued)

OTHER PUBLICATIONS

European Search Report, Application No. 10183713.6, 4 pages, Mar. 4, 2011.
International Search Report and Written Opinion, Application No. PCT/EP2011/067033, 7 pages, Nov. 4, 2011.

(Continued)

*Primary Examiner* — Arthur O Hall
*Assistant Examiner* — Juan C Barrera
(74) *Attorney, Agent, or Firm* — Slayden Grubert Beard PLLC

(57) ABSTRACT

A valve assembly for an injection valve includes a valve body including a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in a further position, an upper retainer arranged in the cavity and fixed to the valve needle, and an electro-magnetic actuator unit configured to actuate the valve needle, the electro-magnetic actuator unit comprising an armature, arranged in the cavity and axially movable relative to the valve needle, the armature configured to be coupled to the upper retainer when the valve needle is actuated to leave the closing position, and a permanent magnet arranged in the cavity adjacent the position of the armature when the valve needle is in its closing position.

20 Claims, 7 Drawing Sheets

(56) References Cited

U.S. PATENT DOCUMENTS

| | | | | |
|---|---|---|---|---|
| 6,520,434 | B1 | 2/2003 | Reiter | 239/585.5 |
| 6,808,133 | B1 * | 10/2004 | Stier | F02M 51/0614 239/585.1 |
| 2006/0202145 | A1 * | 9/2006 | Ricco et al. | 251/129.16 |
| 2009/0302251 | A1 * | 12/2009 | Caldwell | F02M 51/0635 251/129.15 |
| 2010/0236526 | A1 | 9/2010 | Wang et al. | 123/456 |

FOREIGN PATENT DOCUMENTS

| | | | | |
|---|---|---|---|---|
| EP | 1105639 | B1 | 1/2005 | F02M 51/06 |
| EP | 1837516 | A1 | 9/2007 | F02M 51/06 |
| EP | 1845254 | A1 | 10/2007 | F02M 51/06 |
| WO | 2012/041984 | A1 | 4/2012 | F02M 51/06 |

OTHER PUBLICATIONS

Chinese Office Action, Application No. 201180047389.X, 16 pages, Aug. 4, 2014.

* cited by examiner

VALVE ASSEMBLY FOR AN INJECTION VALVE AND INJECTION VALVE

CROSS-REFERENCE TO RELATED APPLICATIONS

This application is a U.S. National Stage Application of International Application No. PCT/EP2011/067033 filed Sep. 29, 2011, which designates the United States of America, and claims priority to EP Application No. 10183713.6 filed Sep. 30, 2010, the contents of which are hereby incorporated by reference in their entirety.

TECHNICAL FIELD

The disclosure relates to a valve assembly for an injection valve and an injection valve.

BACKGROUND

Injection valves are in wide spread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a needle of the injection valve, which may, for example, be an electromagnetic actuator or piezo electric actuator.

In order to enhance the combustion process in view of the creation of unwanted emissions, the respective injection valve may be suited to dose fluids under very high pressures. The pressures may be in case of a gasoline engine, for example, in the range of up to 200 bar and in the case of diesel engines in the range of up to 2000 bar. Already in the near future, need will arise to operate internal combustion engines at still higher fuel pressure values. On the other hand, it is important to provide the engines with different amounts of fuel at different operating conditions. Especially the minimum amount of fuel necessary for operating an engine at idle running conditions will decrease in the future in order to reduce unwanted emissions.

SUMMARY

One embodiment provides a valve assembly for an injection valve, comprising: a valve body including a central longitudinal axis, the valve body comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in at least one further position, an upper retainer being arranged in the cavity and being fixedly coupled to the valve needle, and an electro-magnetic actuator unit being de signed to actuate the valve needle, the electro-magnetic actuator unit comprising an armature, which is arranged in the cavity and which is axially movable relative to the valve needle, the armature being designed to be coupled to the upper retainer when the valve needle is actuated to leave the closing position, wherein a permanent magnet is arranged in the cavity at a position adjacent to the position of the armature, when the valve needle is in its closing position.

In a further embodiment, the permanent magnet is fixedly coupled to the valve body.

In a further embodiment, the permanent magnet is at least partially surrounded by a ring-like non-magnetic element fixedly coupled to the valve body.

In a further embodiment, the ring-like non-magnetic element is of an elastic material.

In a further embodiment, the elastic material is a plastic or a metallic material.

In a further embodiment, the permanent magnet is of a plastic magnetic material.

In a further embodiment, the permanent magnet is overmoulded to the ring-like non-magnetic element.

In a further embodiment, the ring-like non-magnetic element comprises a side-cut in an axial and in a radial direction of the valve needle.

In a further embodiment, the valve body is of a magnetic material.

In a further embodiment, the valve body is of a non-magnetic material.

In a further embodiment, the cavity comprises a step.

In a further embodiment, a washer is arranged between the permanent magnet and the step.

In a further embodiment, a washer is arranged between the permanent magnet and the armature.

In a further embodiment, the washer is fixedly coupled to the valve needle.

Another embodiment provides an injection valve with a valve assembly as disclosed above.

BRIEF DESCRIPTION OF THE DRAWINGS

Exemplary embodiments will be explained in more detail below based on the schematic drawings, wherein.

DETAILED DESCRIPTION

Embodiments of the present disclosed a valve assembly for an injection valve and an injection valve which facilitate a reliable and precise function under almost each of a lot of different operating conditions, when being operated in an internal combustion engine.

For example, some embodiments provide a valve assembly for an injection valve, comprising a valve body including a central longitudinal axis, the valve body comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in at least one further position, an upper retainer being arranged in the cavity and being fixedly coupled to the valve needle, and an electro-magnetic actuator unit being designed to actuate the valve needle, the electro-magnetic actuator unit comprising an armature, which is arranged in the cavity and which is axially movable relative to the valve needle, the armature being designed to be coupled to the upper retainer when the valve needle is actuated to leave the closing position, wherein a permanent magnet is arranged in the cavity at a position adjacent to the position of the armature, when the valve needle is in its closing position.

The application of the permanent magnet enhances both, operating the valve needle more precisely and faster when lifting from the closing position and when moving to the closing position, more or less independently from actual operating conditions.

Other embodiments provide an injection valve including a valve assembly as disclosed herein.

Figure 1:
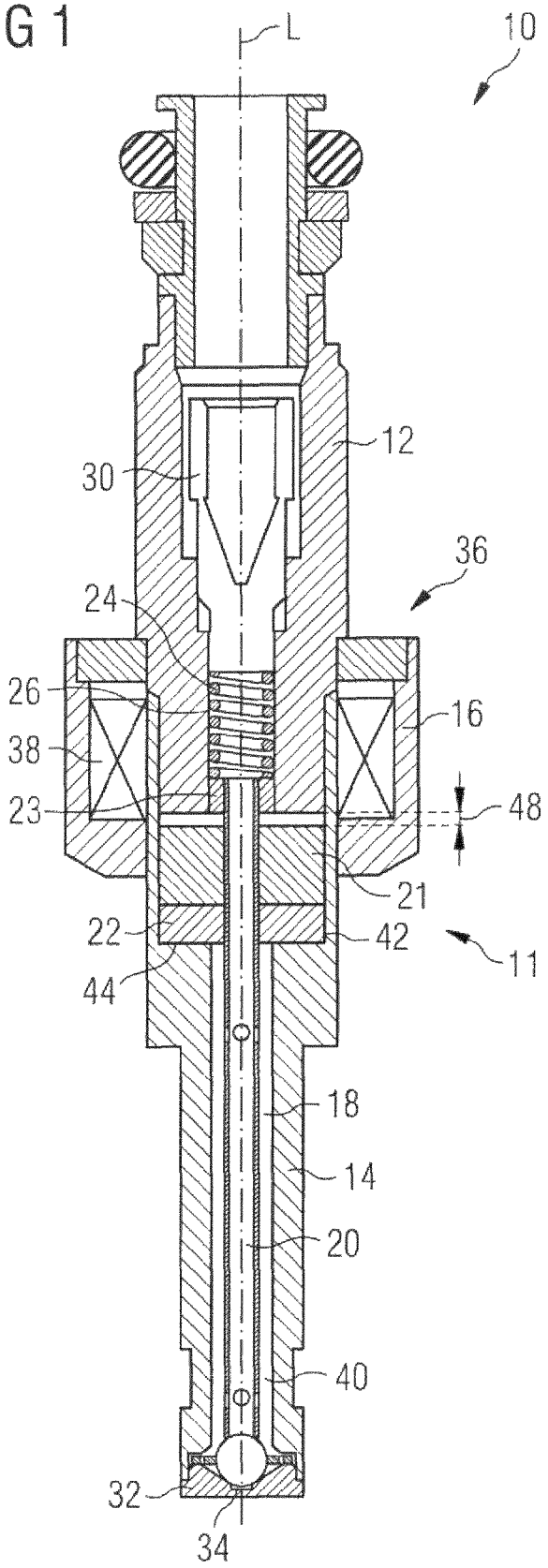
FIGS. 1 and 2 illustrate injection valves with a valve assembly in a longitudinal section view.

An injection valve 10 that is in particular suitable for dosing fuel to an internal combustion engine is shown in FIG. 1 in a longitudinal section view. It comprises in particular a valve assembly 11.

The valve assembly 11 comprises a valve body 14 with a central longitudinal axis L and a housing 16. The housing 16 is partially arranged around the valve body 14. A cavity 18 is arranged in the valve body 14.

The cavity 18 takes in a valve needle 20, an upper retainer 23, and an armature 21. The upper retainer 23 is fixedly coupled to the valve needle 20. The armature 21 is axially movable in the cavity 18, relative to the valve needle 20. The armature 21 is decoupled from the valve needle 20 in axial direction. The upper retainer 23 is formed as a collar around the valve needle 20. A main spring 24 is arranged in a recess 26 provided in the inlet tube 12. The main spring 24 is mechanically coupled to the upper retainer 23. The upper retainer 23 is fixedly coupled to the valve needle 20, and it can guide the valve needle 20 in axial direction inside the inlet tube 12.

A filter element 30 is arranged in the inlet tube 12 and forms a further seat for the main spring 24. During the manufacturing process of the injection valve 10 the filter element 30 can be axially moved in the inlet tube 12 in order to preload the main spring 24 in a desired manner. By this the main spring 24 exerts a force on the valve needle 20 towards an injection nozzle 34 of the injection valve 10.

In a closing position of the valve needle 20 it sealingly rests on a seat plate 32 by this preventing a fluid flow through the at least one injection nozzle 34. The injection nozzle 34 may be, for example, an injection hole. However, it may also be of some other type suitable for dosing fluid.

The valve assembly 11 is provided with an actuator unit 36 that may be an electro-magnetic actuator. The electro-magnetic actuator unit 36 comprises a coil 38, which may be arranged inside the housing 16. Furthermore, the electro-magnetic actuator unit 36 comprises the armature 21. The housing 16, the inlet tube 12, the valve body 14, and the armature 21 are forming an electromagnetic circuit.

The armature 21 is designed to be coupled to the upper retainer 23 when the valve needle 20 is actuated to leave the closing position, and it is designed to be decoupled from the upper retainer when the valve needle 20 is actuated to move to the closing position.

The cavity 18 comprises a fluid outlet portion 40 which is arranged near the seat plate 32. The fluid outlet portion 40 communicates with a fluid inlet portion 42 which is provided in the valve body 14.

Below the armature, in the direction towards the fluid outlet portion, there is arranged a permanent magnet 22. It is fixedly coupled to the valve body 14. Fixing may be achieved, for example, by welding to an inner surface of the valve body 14 in the area of the fluid inlet portion 42 or by providing a step 44 at the fluid inlet portion 42 and coupling the permanent magnet 22 to said step 44.

Figure 2:
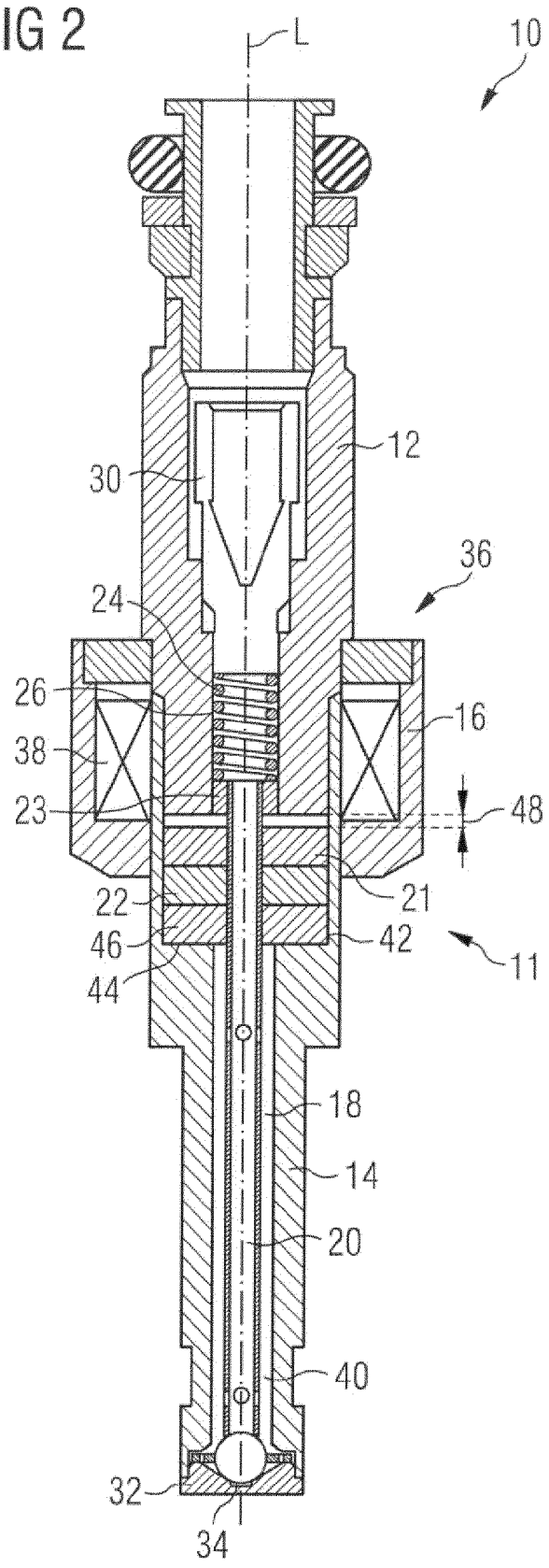

FIG. 2 shows another embodiment of the injection valve. With this embodiment the valve assembly 11 is additionally provided with a washer 46, which is arranged in the fluid inlet portion 42, between the step 44 and the permanent magnet 22.

In order to be able to operate the valve needle 20 precisely, it is necessary to place the permanent magnet 22 and the washer 46 (as far as a washer is provided) at such a position within the fuel inlet portion 42, where in a situation, where the valve needle 20 is in its closing position and where, accordingly, the armature 21 rests on the permanent magnet 22, there is a gap 48 left between a surface of the armature 21 facing an end of the inlet tube 12 and said end of the inlet tube 12, the length of which is at least equal to the maximum value of a lift of the valve needle 20, when lifted off from its closing position.

Figure 3:
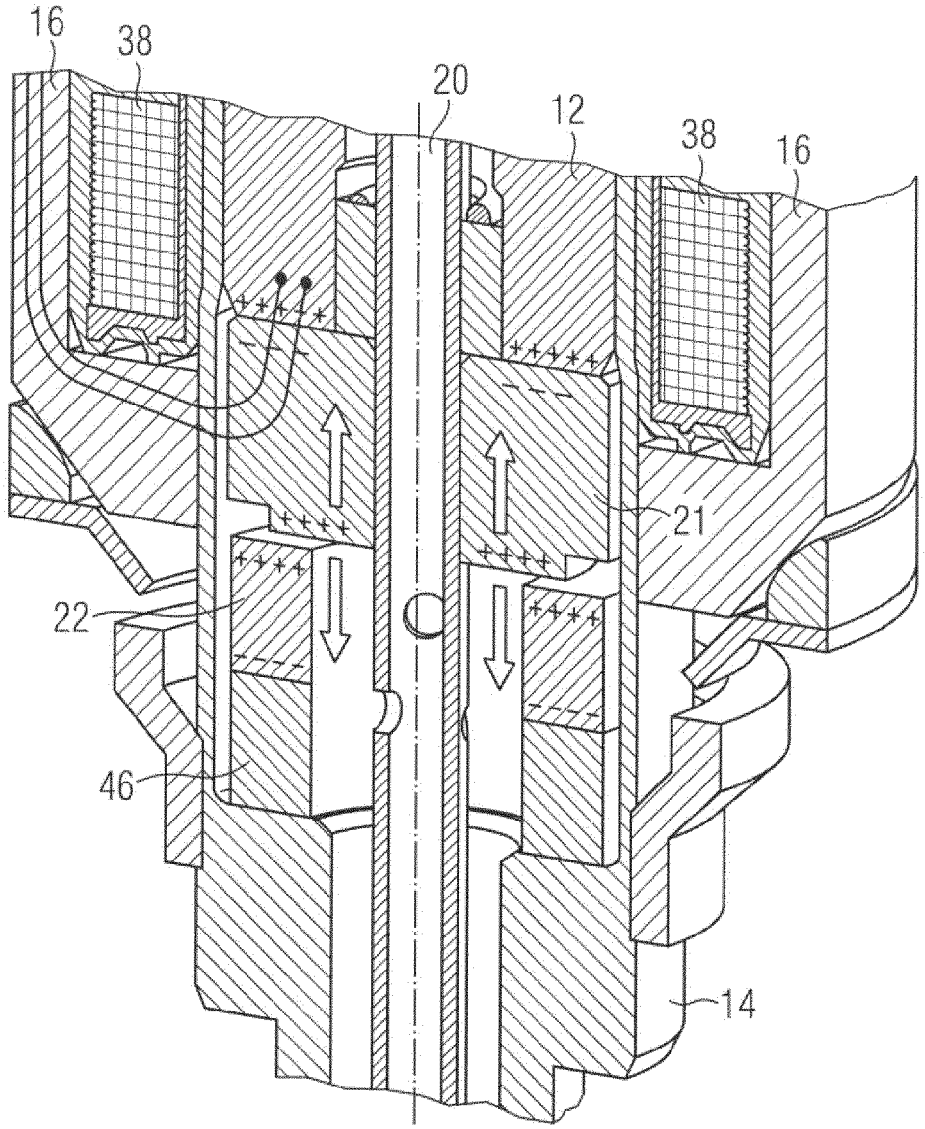
FIGS. 3 and 4 illustrate enlarged views of a section of the valve assembly of FIG. 2.
Figure 4:
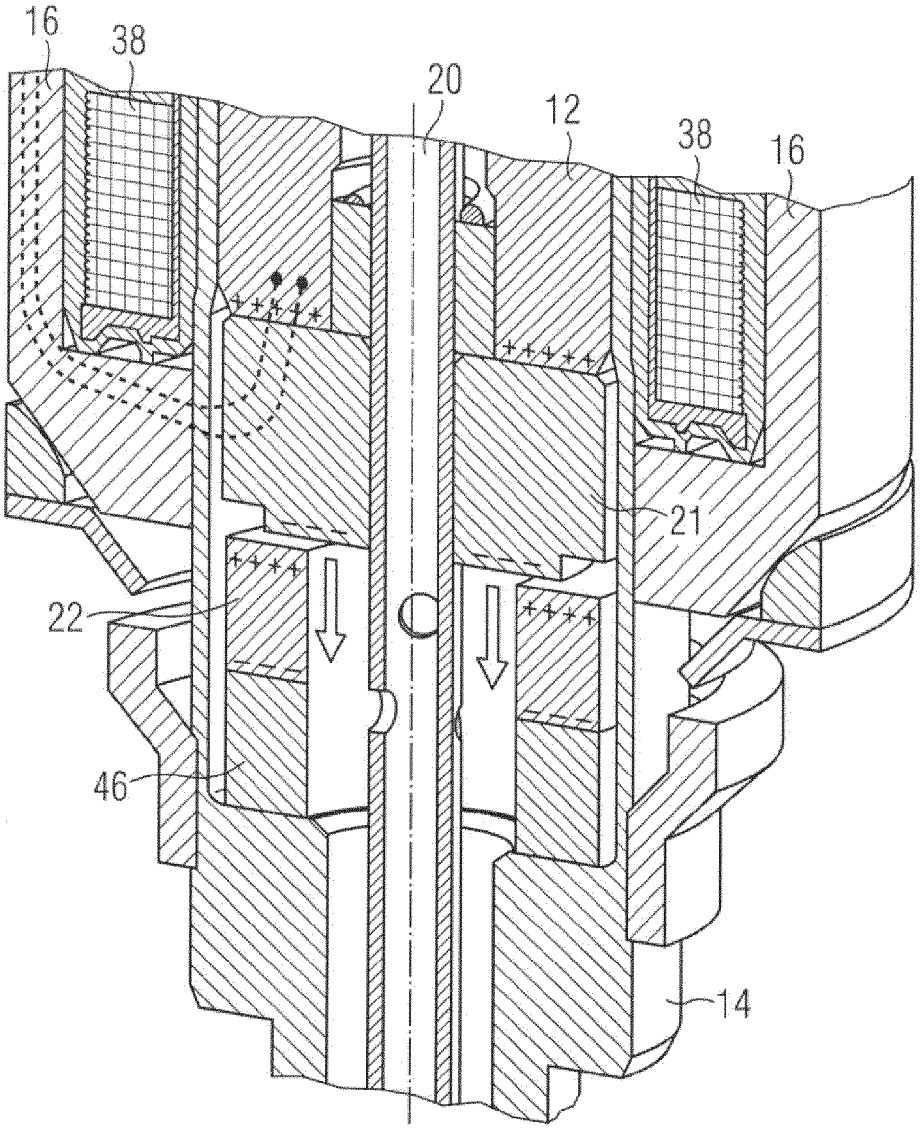

In the following, the function of the injection valve 10 is described in detail, with reference to FIGS. 3 and 4. In these examples it is assumed that the permanent magnet 22 has a magnetic polarity such that the magnetic plus pole is directed towards the armature 21, and that the magnetic minus pole is directed towards the fluid outlet portion 40. The permanent existing magnetic poles and the magnetic poles resulting from energizing (or de-energizing) the coil 38 of the actuator unit are shown in FIGS. 3 and 4 by "+" and "−" symbols. Magnetic flux is shown in FIGS. 3 and 4 by narrow arrows, whereas the directions of the magnetic forces of the armature 21 and of the permanent magnet 22 are shown by bold arrows.

The fluid is led from the fluid inlet portion 42 towards the fluid outlet portion 40. The valve needle 20 prevents a fluid flow through the fluid outlet portion 40 in the valve body 14 in a closing position of the valve needle 20. Outside of the closing position of the valve needle 20, the valve needle 20 enables the fluid flow through the fluid outlet portion 40.

In the closing position of the valve needle 20 the actuator unit 36 is not energized. Due to the magnetic forces exerted by the permanent magnet 22 the armature 21 is pulled towards the permanent magnet 22. Resulting from the magnetic orientation of the permanent magnet 21 that surface of the armature 21 which faces the permanent magnet 22 is of the minus pole type, whereas the surface of the armature 21 facing the inlet tube 12 is of the plus pole type. The spring exerts its force towards the upper retainer 23 which, in turn, presses the valve needle 20 towards the closing position.

In the case when the electro-magnetic actuator unit 36 with the coil 38 gets energized the actuator unit 36 will generate (caused by the magnetic flux) magnetic minus poles at that surface of the armature 21 facing the end of the inlet tube 12, and magnetic plus poles at the end of the inlet tube 12. Accordingly at that surface of the armature 21, which faces the permanent magnet 22, plus poles are generated, facing the plus poles of the permanent magnet 22. Consequently, the armature 21 is not only attracted by the electro-magnetic actuator unit 36 with the coil 38 and moves in axial direction away from the fluid outlet portion 40, but it is also pushed by the permanent magnet 22 towards the upper retainer 23. Accordingly the armature 21 moves faster than in a traditional case, where there is no permanent magnet 22. As a result the valve needle 20 is pushed off from its closing position faster than without support from the permanent magnet 22; it opens faster.

Finally, outside of the closing position of the valve needle 20 a gap between the valve body 14 and the valve needle 20 at the axial end of the injection valve 10 facing away from of the actuator unit 36 forms a fluid path and fluid can pass through the injection nozzle 34.

In the case when the actuator unit 36 is de-energized the main spring 24 forces the upper retainer 23, and consequently the valve needle 20, as it is fixedly coupled to the upper retainer 23, to move in axial direction in the closing position of the valve needle 20. Due to de-energizing the actuator unit 36 and the presence of the permanent magnet 22 the magnetic orientation of the armature 21 is reversed and that surface of the armature 21, which faces the permanent magnet 22, changes into a minus pole orientation. Accordingly the armature 21 is pulled by and towards the permanent magnet 22, as the magnetic orientation of the surface of the permanent magnet 22 facing the armature 21 is of the plus pole orientation.

As a result the valve needle 20 reaches its closing position faster than without the presence of the permanent magnet 22, as the forces of the main spring 24 are supported by the forces exerted by the permanent magnet 22.

Accordingly, by providing traditional valve assemblies and injection valves with a permanent magnet as described herein be fore closing of the valve as well as opening the valve is supported, so that opening and closing can be done faster; the valve assembly and the injection valve can be operated more precisely and at a higher speed.

In some embodiments, the valve body 14 may be of a magnetic material or of a non-magnetic material.

Figure 5:
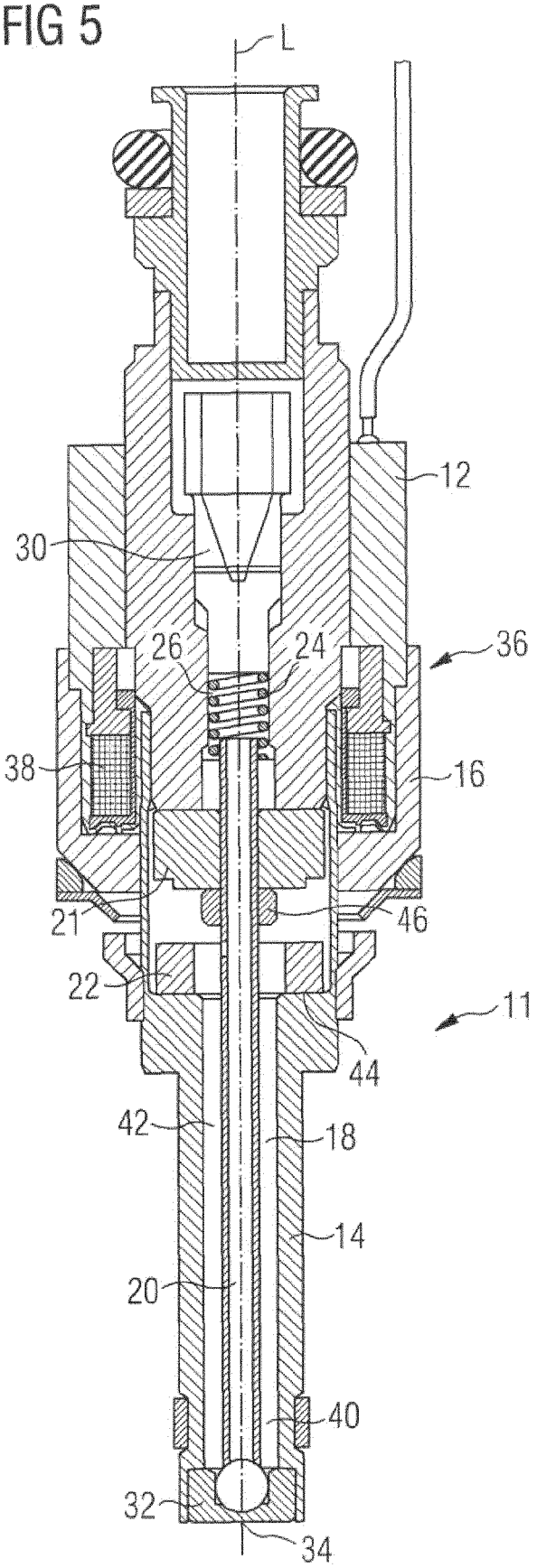
FIG. 5 illustrates another example embodiment.
Figure 6:
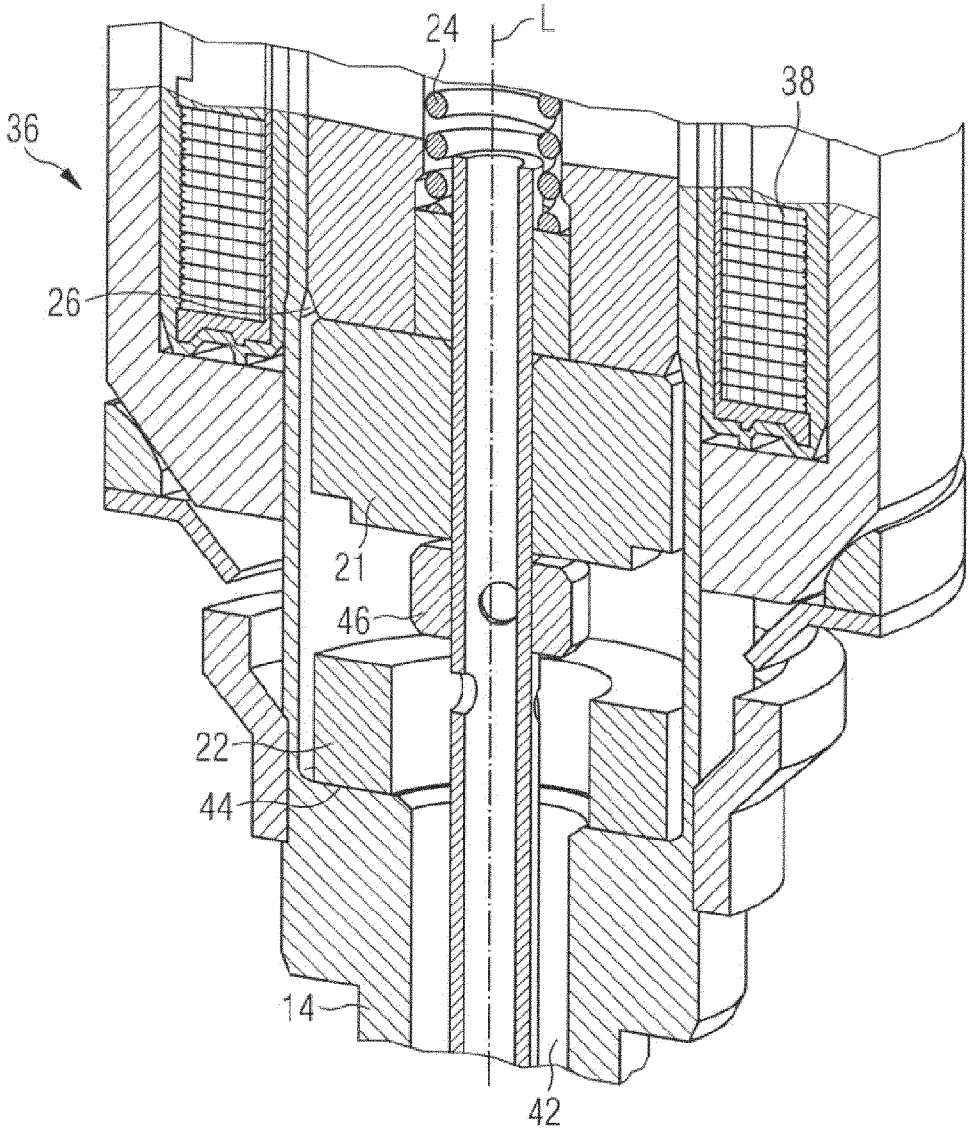
FIG. 6 illustrates details of the example embodiment of FIG. 5.

FIG. 5 shows another embodiment of the valve assembly and injection valve: Whereas with the valve assembly and injection valve of FIG. 2 the washer 46 is arranged beyond the permanent magnet 22, seen in the direction towards the fuel outlet portion 40, with the embodiment of FIG. 5 the washer 46 is arranged between the armature 21 and the permanent magnet 22. This is shown in more detail in FIG. 6. In yet another embodiment, where the washer 46 is arranged between the armature 21 and the permanent magnet 22, the washer 46 may be fixedly coupled to the valve needle 20.

Figure 7:
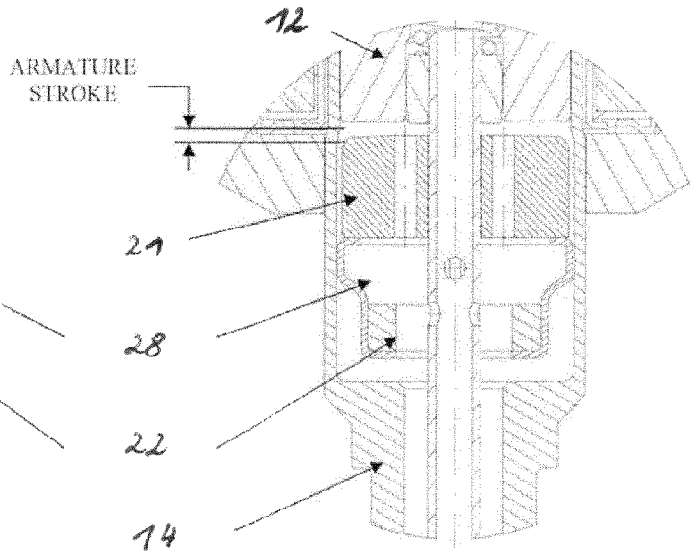
FIG. 7 illustrates another example embodiment.

FIG. 7 shows, partially, another embodiment in which the permanent magnet 22 is surrounded by a ring-like, non-magnetic element 28, looking like a kind of housing. This element 28 is fixedly coupled to the valve body 14. The ring-like, non-magnetic element 28 may be made of an elastic material like a plastic material or a metallic material. The permanent magnet 22 may be made of a plastic magnetic material. Further on, the permanent magnet 22 may be overmoulded to the ring-like, non-magnetic element 28.

Figure 8:
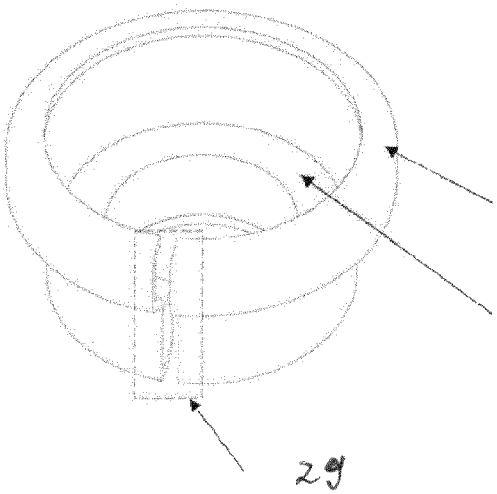
FIG. 8 illustrates details of the example embodiment of FIG. 7.

Such a ring-like, non-magnetic element 28 may be provided with a side-cut 29, running along an axial and a radial direction of the valve needle 20. In FIG. 8 there is shown the ring-like, non-magnetic element 28, provided with said side-cut 29.

Assembling the parts of such a valve assembly 11 may be relatively easier, less complicated, and also production of contamination, resulting from the assembling procedure itself, may be significantly reduced, as compared with conventional designs.

When mounting the ring-like, non-magnetic element 28, provided with said side-cut 29 and with the permanent magnet 22, to the valve body 14 it is possible to press together the sidewall of the ring-like, non-magnetic element 28 until the outer diameter thereof is smaller than the inner diameter of the fluid inlet portion 42 of the valve body 14 at a position, where the permanent magnet 22, together with the ring-like, non-magnetic element 28, has to be mounted. Then the arrangement of ring-like, non-magnetic element 28 and the permanent magnet 22 can be brought into the valve body 14 to said position, and the pressing can be finished. Accordingly, the diameter of the ring-like, non-magnetic element 28 increases to its former value, which should have been designed to as to be greater than the value of said inner diameter of the fluid inlet portion 42. In this way said arrangement is fixed to the fluid inlet portion 42, whereby there is a good interference there between.

The cost may also be reduced. For fixedly coupling the permanent magnet 22 directly to the fluid inlet portion 42 it may be necessary to have the magnet made of a material, with which the permanent magnet 22 can be produced at very exact dimensions with very small tolerances. Such a material, however, is very expensive. In opposition to this, however, when mounting the permanent magnet 22 together with said ring-like, non-magnetic element 28 to the fluid inlet portion 42, a material may be used for fabricating the permanent magnet 22, which results in greater tolerances with the permanent magnet 22. And such a material normally is much cheaper than said material resulting in permanent magnets with said very small tolerances.

REFERENCE NUMERALS

10 injection valve
11 valve assembly
12 inlet tube
14 valve body
16 housing
18 cavity
20 valve needle
21 armature
22 permanent magnet
23 upper retainer
24 main spring
26 recess of inlet tube
28 ring-like non-magnetic element
29 side-cut
30 filter element
32 seat plate
34 injection nozzle
36 actuator unit
38 coil
40 fluid outlet portion
42 fluid inlet portion
44 step
46 washer
48 gap
L Longitudinal central axis

What is claimed is:

1. Valve assembly for an injection valve, comprising:

a valve body having a central longitudinal axis and a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in at least one further position, an upper retainer arranged in the cavity and fixedly coupled to the valve needle, an electro-magnetic actuator unit configured to actuate the valve needle, the electro-magnetic actuator unit comprising an armature, arranged in the cavity and axially movable relative to the valve needle, the armature configured to be coupled to the upper retainer to activate the valve needle to leave the closing position, and a permanent magnet arranged in the cavity at a position adjacent to the position of the armature when the valve needle is in its closing position.

2. Valve assembly of claim 1, wherein the permanent magnet is fixedly coupled to the valve body.

3. Valve assembly of claim 1, wherein the permanent magnet is at least partially surrounded by a ring-like element fixedly coupled to the valve body.

4. Valve assembly of claim 3, wherein the ring-like is formed from an elastic material.

5. Valve assembly of claim 4, wherein the elastic material is a plastic or a metallic material.

6. Valve assembly of claim 3, wherein the permanent magnet is formed from a plastic magnetic material.

7. Valve assembly of claim 3, wherein the permanent magnet is overmoulded to the ring-like element.

8. Valve assembly of claim 3, wherein the ring-like element comprises a side-cut in an axial and in a radial direction of the valve needle.

9. Valve assembly of claim 1, wherein the valve body is formed from a magnetic material.

10. Valve assembly of claim 1, wherein the valve body is formed from a non-magnetic material.

11. Valve assembly of claim 1, wherein the cavity comprises a step.

12. Valve assembly of claim 11, wherein a washer is arranged between the permanent magnet and the step.

13. Valve assembly of claim 11, wherein a washer is arranged between the permanent magnet and the armature.

14. Valve assembly of claim 13, wherein the washer is fixedly coupled to the valve needle.

15. An injection valve comprising:

a valve assembly comprising:

a valve body having a central longitudinal axis and a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in at least one further position, an upper retainer arranged in the cavity and fixedly coupled to the valve needle, an electro-magnetic actuator unit configured to actuate the valve needle, the electro-magnetic actuator unit comprising an armature, arranged in the cavity and axially movable relative to the valve needle, the armature configured to be coupled to the upper retainer to activate the valve needle to leave the closing position, and a permanent magnet arranged in the cavity at a position adjacent to the position of the armature when the valve needle is in its closing position.

16. The injection valve of claim 15, wherein the permanent magnet is fixedly coupled to the valve body.

17. The injection valve of claim 15, wherein the permanent magnet is at least partially surrounded by a ring-like element fixedly coupled to the valve body.

18. The injection valve of claim 17, wherein the permanent magnet is overmoulded to the ring-like element.

19. The injection valve of claim 17, wherein the ring-like element comprises a side-cut in an axial and in a radial direction of the valve needle.

20. The injection valve of claim 15, wherein the cavity comprises a step, and wherein a washer is arranged between the permanent magnet and the step.

* * * * *